US006037112A

United States Patent [19]

Dickerson

[11] Patent Number: 6,037,112

[45] Date of Patent: Mar. 14, 2000

[54] MEDICAL DIAGNOSTIC FILM FOR SOFT TISSUE IMAGING (II)

[75] Inventor: Robert E. Dickerson, Hamlin, N.Y.

[73] Assignee: Eastman Kodak Company, Rochester, N.Y.

[21] Appl. No.: 09/172,388

[22] Filed: Oct. 14, 1998

[51] Int. Cl.[7] ..... G03C 1/46

[52] U.S. Cl. ..... 430/502; 430/507; 430/517; 430/567; 430/569; 430/966

[58] Field of Search ..... 430/567, 569, 430/966, 502, 507, 517

[56] References Cited

U.S. PATENT DOCUMENTS

| | | | |
|---|---|---|---|
| 3,545,971 | 12/1970 | Barnes et al. . | |
| 4,414,304 | 11/1983 | Dickerson . | |
| 4,425,425 | 1/1984 | Abbott et al. . | |
| 4,425,426 | 1/1984 | Abbott et al. . | |
| 4,710,637 | 12/1987 | Luckey et al. . | |
| 4,803,150 | 2/1989 | Dickerson et al. . | |
| 4,900,652 | 2/1990 | Dickerson et al. . | |
| 5,738,981 | 4/1998 | Dickerson et al. . | |
| 5,759,754 | 6/1998 | Dickerson | 430/502 |
| 5,853,967 | 12/1998 | Dickerson | 430/502 |

*Primary Examiner*—Janet Baxter
*Assistant Examiner*—Amanda C. Walke
*Attorney, Agent, or Firm*—Carl O. Thomas

[57] ABSTRACT

A radiation-sensitive medical diagnostic film for soft tissue imaging, particularly mammography, is disclosed. The film allows more rapid processing than films currently available for mammographic imaging and maintains acceptably high levels of image sharpness and low levels of mottle. The radiographic film records medical diagnostic images of soft tissue through (a) exposure by a single intensifying screen located to receive an image bearing source of X-radiation and (b) processing, including development, fixing and drying, in 90 seconds or less comprised of a film support transparent to radiation emitted by the intensifying screen and having opposed front and back major faces and an image-forming portion for providing, when imagewise exposed by the intensifying screen and processed, an average contrast in the range of from 2.5 to 3.5, measured over a density above fog of from 0.25 to 2.0. The image-forming portion is comprised of (i) a processing solution permeable front layer unit coated on the front major face of the support capable of absorbing up to 70 percent of the exposing radiation and containing less than 40 mg/dm$^2$ of hydrophilic colloid and less than 40 mg/dm$^2$ silver in the form of radiation-sensitive silver halide grains, and (ii) a processing solution permeable back layer unit coated on the back major face of the support containing less than 40 mg/dm$^2$ of hydrophilic colloid, silver in the form of radiation-sensitive silver halide grains accounting for from 20 to 45 percent of the total radiation-sensitive silver halide present in the film, and a dye capable of providing an optical density of at least 0.40 in the wavelength region of the exposing radiation intended to be recorded and an optical density of less than 0.1 in the visible spectrum at the conclusion of film processing. Tabular grains account for greater than 50 percent of total grain projected area in the back layer unit, and the back layer unit exhibits a speed that ranges from 0.3 log E to 1.0 log E slower than the front layer unit to facilitate (a) visualizing anatomical features in areas of high film exposure and (b) minimizing any adverse effect of the tabular grains on desirable cold overall image tone.

15 Claims, No Drawings

MEDICAL DIAGNOSTIC FILM FOR SOFT TISSUE IMAGING (II)

FIELD OF THE INVENTION

The invention relates to films containing radiation-sensitive silver halide emulsions for creating medical diagnostic images of soft tissue when imagewise exposed with an intensifying screen.

DEFINITIONS

James *The Theory of the Photographic Process,* 4th Ed., Macmillan, New York, 1977, is hereinafter referred to as "James".

References to silver halide grains or emulsions containing two or more halides name the halides in order of ascending concentrations (see James p. 4).

The terms "high bromide" and "high chloride" refer to silver halide grains and emulsions that contain greater than 50 mole percent bromide or chloride, respectively, based on total silver.

The term "equivalent circular diameter" or "ECD" is employed to indicate the diameter of a circle having an area equal to the protected area of a silver halide grain.

The term "coefficient of variation" or "COV" as applied to silver halide grains is used to indicate 100 times the standard deviation ($\sigma$) of grain ECD divided by mean grain ECD.

The term "tabular grain" refers to a grain having parallel major faces that are clearly larger than any other crystal face of the grain.

The term "thin tabular grain" refers to a tabular grain than exhibits a thickness of less than 0.3 $\mu$m.

The term "tabular grain emulsion" refers to an emulsion in which tabular grain account for greater than 50 percent of total grain projected area.

The "aspect ratio" of a tabular grain is its ECD divided by its thickness (t).

The terms "low aspect ratio", "intermediate aspect ratio" and "high aspect ratio" indicate aspect ratios of (a) less than 5, (b) 5 to 8 and (c) greater than 8, respectively.

The terms "front" and "back" are herein employed to indicate the sides of a film nearest and farthest, respectively, from the source of image bearing radiation.

The term "dual-coated" refers to a film that has silver halide emulsion layers coated on opposite sides of its support.

The term "half peak absorption bandwidth" of a dye is the spectral range in nm over which it exhibits a level of absorption equal to at least half of its peak absorption ($\lambda_{max}$).

The term "rapid access processor" is employed to indicate a radiographic film processor that is capable of providing dry-to-dry processing in 90 seconds or less. The term "dry-to-dry" is used to indicate the processing cycle that occurs between the time a dry, imagewise exposed element enters a processor to the time it emerges, developed, fixed and dry.

The term "point-gamma" or "point $\gamma$" is the ratio of the change of density ($\Delta D$) divided by the change of log exposure ($\Delta E$) at any specified point on a characteristic curve (a plot of density versus log exposure).

Exposure (E) is measured in lux-seconds.

Average contrast is the slope of a line drawn between characteristic curve points at a density of 0.25 above fog and at a density 2.0 above fog.

The acronym "MTF" is employed in referring to modulation transfer factors and modulation transfer functions. Modulation transfer factor measurement for intensifying screen-radiographic film systems is described by Kuniio Dio et al, "MTF and Wiener Spectra of Radiographic Screen-Film Systems", U.S. Department of Health and Human Services, pamphlet FDA 82-8187. The profile of individual modulation transfer factors over a range of cycles per mm constitutes a modulation transfer function. MTF measurements provide an art recognized quantification of radiographic image sharpness.

The term "mottle" refers to image noise. According to accepted usage in the art, the term "structure mottle" is used to indicate the image noise attributable to the structure of the radiographic element (and intensifying screen or screens, if employed) while the term "quantum mottle" is used to indicate the image noise attributable to the source of X-radiation employed.

The term "cold" in referring to image tone is used to mean an image tone that has a CIELAB b* value measured at a density of 1.0 above minimum density that is −6.5 or more negative. Measurement technique is described by Billmeyer and Saltzman, Principles of Color Technology, 2nd Ed., Wiley, New York, 1981, at Chapter 3. The b* values describe the yellowness vs. blueness of an image with more positive values indicating a tendency toward greater yellowness.

*Research Disclosure* is published by Kenneth Mason Publications, Ltd., Dudley House, 12 North St., Emsworth, Hampshire P010 7DQ, England.

BACKGROUND OF THE INVENTION

The use of radiation-sensitive silver halide emulsions for medical diagnostic imaging can be traced to Roentgen's discovery of X-radiation by the inadvertent exposure of a silver halide photographic element. In 1913 the Eastman Kodak Company introduced its first product specifically intended to be exposed to X-radiation.

The desirability of limiting patient exposure to high levels of X-radiation has been recognized from the inception of medical radiography. In 1918 the Eastman Kodak Company introduced the first medical radiographic product which was dual-coated—that is, coated with silver halide emulsion layers on the front and back of the support.

At the same time it was recognized that silver halide emulsions are more responsive to light than to X-radiation. The Patterson Screen Company in 1918 introduced matched intensifying screens for Kodak's first dual-coated (Duplitized™) radiographic element. An intensifying screen contains a phosphor that absorbs X-radiation and emits radiation of a longer wavelength, usually in the near ultraviolet, blue or green portion of the spectrum.

While the necessity of limiting patient exposure to high levels of X-radiation was quickly appreciated, the question of patient exposure to even low levels of X-radiation emerged gradually. The separate development of soft tissue radiography, which requires much lower levels of X-radiation, can be illustrated by mammography. The first intensifying screen-radiographic film combination for mammography was introduced in the early 1970's. Mammographic film contains a single silver halide emulsion layer and is exposed by a single intensifying screen, usually interposed between the film and the source of X-radiation. Mammography employs low energy X-radiation—that is, radiation which is predominantly of an energy level less than 40 keV.

In mammography, as in many forms of soft tissue radiography, pathological features sought to be identified are often quite small and not much different in density than surrounding healthy tissue. Thus, relatively high average contrast, in the range of from 2.5 to 3.5, over a density range of from 0.25 to 2.0 is typical. Limiting X-radiation energy levels increases the absorption of the X-radiation by the intensifying screen and minimizes X-radiation exposure of the film, which can contribute to loss of image sharpness and contrast.

As radiologists began to generate large volumes of medical diagnostic images, the need arose for more rapid processing. The emergence of rapid access processing is illustrated by Barnes et al U.S. Pat. No. 3,545,971. Successful rapid access processing requires limiting the drying load—that is, the water ingested by the hydrophilic colloid layers, including the silver halide emulsion layers, that must be evaporated to produce a dry image bearing element. One possible approach is to foreharden the film fully, thereby reducing swelling (water ingestion) during processing. Because silver image covering power (maximum density divided by the silver coating coverage) of silver halide medical diagnostic films was markedly reduced by forehardening of the films, it was for many years the accepted practice not to foreharden the films fully, but to complete hardening of diagnostic films during rapid access processing by incorporating a pre-hardener, typically glutaraldehyde, in the developer. Dickerson U.S. Pat. No. 4,414,304 (hereinafter referred to as Dickerson I) demonstrates full forehardening with low losses in covering power to be achievable with thin (<0.3 $\mu$m) tabular grain emulsions.

Since adopting full forehardening of tabular grain silver halide emulsion containing radiographic elements further efforts to reduce the drying load placed on the rapid access processors has largely focused on limiting the hydrophilic colloid content of the medical diagnostic elements. However, when the hydrophilic colloid content of the emulsion layer falls too low, the problem of wet pressure sensitivity is encountered. Wet pressure sensitivity is the appearance of graininess produced by applying pressure to the wet emulsion during development. In rapid access processing the film passes over guide rolls, which are capable of applying sufficient pressure to the wet emulsion during development to reveal any wet pressure sensitivity, particularly if any of the guide rolls are in less than optimum adjustment.

Since mammographic films locate all of the silver halide emulsion on one side of the support, the resulting layer unit contains higher silver halide and hydrophilic colloid coating coverages and hence larger amounts of water ingested during development and fixing that must be removed during drying than the layer units of a dual-coated film, which approximately halves the silver halide and hydrophilic colloid per side by dividing the silver halide and hydrophilic colloid equally between front and back layer units. Thus, conventional dual-coated films are capable of more acceleration of rapid access processing than mammographic films.

There are several problems that have kept mammographic films from successfully adopting dual-coated formats and thereby improving their rapid access processing capability. Dual-coated films have been conventionally exposed with a front and back pair of intensifying screens. The front screen is provided to expose the layer unit on the front side of the film support and the back screen is provided to expose the layer unit on the back side of the support. Unfortunately some of the light emitted by the front screen also exposes the back layer unit and some of the light emitted by the back screen exposes the front layer unit. This results in a reduction in sharpness and is referred to as crossover.

Abbott et al U.S. Pat. Nos. 4,425,425 and 4,425,426 (hereinafter collectively referred to as Abbott et al) demonstrate that spectrally sensitized tabular grain emulsions are capable of reducing crossover to less than 20 percent—that is, less than 20 percent of the light emitted by the front screen is transmitted to the back layer unit.

Subsequently, Dickerson et al U.S. Pat. Nos. 4,803,150 and 4,900,652 (hereinafter referred to as Dickerson et al I and II) demonstrated an arrangement for essentially eliminating crossover by employing spectrally sensitized tabular grain emulsions in combination with front and back coatings that contain a particulate processing solution decolorizable dye interposed between the front and back emulsion layers and the support. Unfortunately, this requires two additional hydrophilic colloid layers to accommodate the added processing solution decolorizable dye. Nevertheless, Dickerson et al I and II demonstrate management of hydrophilic colloid in a dual-coated format to realize the advantage of accelerated rapid access processing.

Luckey et al U.S. Pat. No. 4,710,637 represents an unsuccessful attempt to undertake mammographic imaging using dual-coated film. To allow a front and back pair of intensifying screens to be employed in combination with a dual-coated film, Luckey et al found it necessary to thin the front screen to limit its absorption of low energy X-radiation. Although the teachings of Luckey et al and Abbott et al and eventually those of Dickerson et al I and II were all employed, the commercial sale of dual-coated mammographic film was discontinued for lack of acceptance by radiologists. The radiologists found pathology diagnoses to be unduly complicated by objectionable image characteristics that could not be eliminated. Use of a front and back intensifying screen pair to expose the dual-coated film increased the sharpness (MTF) and X-radiation transmission requirements for the front screen as compared to a single screen, single emulsion layer unit imaging system, leading to unattainable uniformity requirements for the front screen phosphor layer. In other words, the dual-coated films failed to produce mammographic images acceptable to radiologists, since they placed performance requirements on the front screens of the intensifying screen pairs used for their exposure that could not be satisfied.

Typically dual-coated silver halide medical diagnostic films are processed in a rapid access processor in 90 seconds or less. For example, the Kodak X-OMAT M6A-N™ rapid access processor employs the following processing cycle:

| | |
|---|---|
| Development | 24 seconds at 35° C. |
| Fixing | 20 seconds at 35° C. |
| Washing | 20 seconds at 35° C. |
| Drying | 20 seconds at 65° C. |

with up to 6 seconds being taken up in film transport between processing steps.

A typical developer (hereinafter referred to as Developer A) exhibits the following composition:

| | |
|---|---|
| Hydroquinone | 30 g |
| Phenidone ™ | 1.5 g |
| KOH | 21 g |
| $NaHCO_3$ | 7.5 g |
| $K_2SO_3$ | 44.2 g |
| $Na_2S_2O_3$ | 12.6 g |

-continued

| | |
|---|---|
| NaBr | 35.0 g |
| 5-Methylbenzotriazole | 0.06 g |
| Glutaraldehyde | 4.9 g |
| Water to 1 liter/pH 10.0 | |
| A typical fixer exhibits the following composition: | |
| Sodium thiosulfate, 60% | 260.0 g |
| Sodium bisufite | 180.0 g |
| Boric acid | 25.0 g |
| Acetic acid | 10.0 g |
| Water to 1 liter/pH 3.9–4.5 | |

Radiation-sensitive silver halide containing radiographic film for recording medical diagnostic images of soft tissue (e.g., mammographic film) through exposure by a single intensifying screen located to receive X-radiation and emit light to the film have required all of the latent image-forming silver halide grains to be coated on one side of the support to achieve optimum levels of image sharpness. This in turn requires a higher coating coverage of hydrophilic colloid than is employed on either side of dual-coated radiographic films. The higher hydrophilic colloid coverages limit the extent to which rapid access processing can be accelerated. Thus, currently mammographic and similar soft tissue imaging medical diagnostic films are coated in a single-sided format to maximize image sharpness and uniformity, but cannot achieve the higher rates of rapid access processing finding increasing use in processing dual-coated radiographic films.

An attempt by Luckey et al, cited above, to provide mammographic film in dual-coated format was ultimately rejected by radiologists for failing to provide images of acceptably high sharpness and low mottle.

No medical diagnostic radiographic film for imaging soft tissue, such as mammographic film, has heretofore been available combining high levels of image sharpness and uniformity and the capability of accelerated rates of rapid access processing attainable with dual-coated radiographic films.

Dickerson et al U.S. Pat. No. 5,738,981 discloses the use of a dual-coated film exposed from one side by a cathode ray tube, photodiode or laser for reproducing digitally stored medical diagnostic images through exposure and processing, including development, fixing and drying, in 90 seconds. Since this film is intended to be used only to reproduce images that have already been captured by X-radiation exposure and converted to a digital form, the construction of the film is chosen to minimize image noise and to maximize processing convenience at the expense of radiation sensitivity. Thus, design considerations are quite different from that of medical diagnostic imaging that exposes a patient to X-radiation. Tabular grain emulsions are not preferred. Instead preferred emulsions have mean grain ECD's of less than 0.4 μm. Additionally high chloride emulsions are preferred to facilitate processing, even though high chloride emulsions generally exhibit lower sensitivity than high bromide emulsions with otherwise comparable grains.

CROSS REFERENCES

This patent application is an improvement on Dickerson U.S. Pat. No. 5,759,754 (hereinafter referred to as Dickerson II).

Dickerson U.S. Ser. No. 09/172,363, concurrently filed and commonly assigned, titled MEDICAL DIAGNOSTIC FILM FOR SOFT TISSUE IMAGING (I), is directed to a radiographic film for recording medical diagnostic images of soft tissue through (a) exposure by a single intensifying screen located to receive an image bearing source of X-radiation and (b) processing, including development, fixing and drying, in 90 seconds or less comprised of a film support transparent to radiation emitted by the intensifying screen and having opposed front and back major faces and an image-forming portion for providing, when imagewise exposed by the intensifying screen and processed, an average contrast in the range of from 2.5 to 4.0, measured over a density above fog of from 0.25 to 2.0, wherein the image-forming portion is comprised of (i) a processing solution permeable front layer unit coated on the front major face of the support capable of absorbing up to 70 percent of the exposing radiation and containing (a) hydrophilic colloid, the hydrophilic colloid being limited to less than 40 mg/dm$^2$, and (b) radiation-sensitive silver halide grains having an average thickness of greater than 0.3 μm and an average aspect ratio of less than 5, the coating coverage of the silver halide grains being limited to less than 40 mg/dm$^2$, based on the weight of silver, and (ii) a processing solution permeable back layer unit coated on the back major face of the support containing (a) hydrophilic colloid, the hydrophilic colloid being limited to less than 40 mg/dm$^2$, (b) silver in the form of radiation-sensitive silver halide grains accounting for from 20 to 45 percent of the total radiation-sensitive silver halide present in the film, tabular grains having a thickness of less than 0.3 μm accounting for greater than 50 percent of the total projected area of the radiation-sensitive silver halide grains in the back layer unit, and (c) a dye capable of providing an optical density of at least 0.40 in the wavelength region of the exposing radiation intended to be recorded and an optical density of less than 0.1 in the visible spectrum at the conclusion of film processing, the dye being excluded from a first layer of the back layer unit containing at least 20 percent of the radiation-sensitive grains within the back layer unit and being present in at least one remaining layer coated farther from the support than the first layer, the hydrophilic colloid of the front layer unit being hardened to a lesser extent than the hydrophilic colloid of the back layer unit.

SUMMARY OF THE INVENTION

In one aspect this invention is directed to a radiographic film for recording medical diagnostic images of soft tissue through (a) exposure by a single intensifying screen located to receive an image bearing source of X-radiation and (b) processing, including development, fixing and drying, in 90 seconds or less comprised of a film support transparent to radiation emitted by the intensifying screen and having opposed front and back major faces and an image-forming portion for providing, when imagewise exposed by the intensifying screen and processed, an average contrast in the range of from 2.5 to 4.0[1], measured over a density above fog of from 0.25 to 2.0, wherein the image-forming portion is comprised of (i) a processing solution permeable front layer unit coated on the front major face of the support capable of absorbing up to 70[2] percent of the exposing radiation and containing (a) hydrophilic colloid, the hydrophilic colloid being limited to less than 40[3] mg/dm$^2$, and (b) radiation-sensitive silver halide grains having an average thickness of greater than 0.3[4] μm and an average aspect ratio of less than 5, the coating coverage of the silver halide grains being limited to less than 40[3] mg/dm$^2$, based on the weight of silver, and (ii) a processing solution permeable back layer unit coated on the back major face of the support containing (a) hydrophilic colloid, the hydrophilic colloid being limited to less than 40 mg/dm$^2$, (b) silver in the form of radiation-sensitive silver halide grains accounting for from 20 to 45[5] percent of the total radiation-sensitive silver halide present in the film, tabular grains having a thickness of less than 0.3[6] μm and an average aspect ratio of greater than 5 accounting for at least 70 percent of the total projected area of the radiation-sensitive silver halide grains in the back layer unit, and (c) a dye capable of providing an optical density of at least 0.40 in the wavelength region of the exposing radiation intended to be recorded and an optical density of less than 0.1 in the visible spectrum at the conclusion of film processing, the dye being excluded from a first layer of the back layer unit containing at least 20 percent of the radiation-sensitive grains within the back layer unit and being present in at least one remaining layer coated farther from the support than the first layer, the hydrophilic colloid of the front layer unit being hardened to a lesser extent[7] than the hydrophilic colloid of the back layer unit the back layer unit having a speed ranging from 0.3 log E to 1.0 log E slower than the front layer unit[8], where the speed of the front layer unit is measured at a density of the front layer unit of 1.0 above fog and the speed of the back layer unit is measured at a density of the back layer unit of 1.0 above fog.

[2]Whereas Dickerson II limits maximum contrast to 3.5, the customary upper limit for soft tissue imaging, this invention extends the upper limit of contrast to 4.0.

[2] Whereas Dickerson II limits maximum absorption to 60 percent, this invention extends the upper limit of absorption to 70 percent.

[3]Whereas Dickerson II limits hydrophilic colloid and silver coverages in the front layer unit to 30 mg/dm$^2$, this invention extends the upper limit to 40 mg/dm$^2$.

[4] Whereas Dickerson II recites the presence of "radiation-sensitive silver halide grains" in the front layer unit without further qualification, it is now contemplated to restrict the radiation-sensitive silver halide grains in the front layer unit to those having an average thickness of greater than 0.3 μm.

[5] Whereas Dickerson II recites that the radiation-sensitive grains in the back layer unit account for from 40 to 60 percent of total silver, the present invention contemplates lowering silver coverage to 20 to 45 (preferably 25 to 40) percent of total silver.

[6] Whereas Dickerson II recites the presence of "radiation-sensitive silver halide grains" in the front layer unit without further qualification, it is now contemplated to restrict the radiation-sensitive silver halide grains in the front layer unit to tabular grains having an average thickness of less than 0.3 μm.

[7] This invention adds to the requirements of Dickerson II the further requirement that the hydrophilic colloid forming the front layer unit is hardened to a lesser extent than the hydrophilic colloid forming the back layer unit.

[8] This invention adds to the requirements of Dickerson II the further requirement that the back layer unit exhibit a speed ranging from 0.3 log E to 1.0 log E slower than the front layer unit.

The present invention has as its purpose to provide all of the improvements over conventional soft tissue imaging described in Dickerson II and to offer additional advantages as described below.

The bracketed superscripts locate differences from claim 1 of Dickerson II.

The present invention constitutes a significant advance in the art over conventional radiographic elements employed with a single intensifying screen for medical diagnostic imaging soft tissue. These elements coat relatively thick (>0.3 μm) non-tabular grains on only one side of a support. Single-sided coating of emulsion has been thought necessary to achieve sharp images. Non-tabular grains are chosen for their capability of producing acceptable levels of image contrast and their capability of producing desirably cold image tones.

The limitations of these conventional medical diagnostic elements include (a) a limited rapid access processing capability, attributable to the single-sided coating format and the non-tabular grains, and (b) a limited ability to increase contrast, desirable for locating anatomical features of interest while still retaining an ability to locate the skin line, thereby facilitating location of the anatomical feature. For example, it is frustrating to be able to see an image of a breast tumor requiring removal while being unable to see the skin-line to locate the tumor precisely within the breast.

The radiographic film for recording medical diagnostic images of soft tissue of this invention retain the advantages of conventional elements of this type, including desirably cold image tones and the ability to employ a single intensifying screen, while (a) offering a film structure that can be permits more rapid processing and (b) allows higher contrast images of anatomical features to be obtained, thereby facilitating their visual detection, while retaining the capability of seeing the skin line—that is, capability of locating the anatomical feature in relation to the surface of the patient's body.

This desirable and heretofore unattained combination of capabilities has been achieved by constructing an unusual dual-coated format that allows sharp images to be obtained by using a single intensifying screen, as taught by Dickerson II, further modified by substituting radiation-sensitive thin tabular grains for a portion of the non-tabular grains. Limiting the percentage of total silver accounted for by tabular grains, locating the tabular grains on the back side of the support, and reducing the speed of the tabular grains in relation to that of the non-tabular grains have each contributed to achieving desirably cold image tones. The reduction of the speed of the tabular grains in relation to the speed of the retained non-tabular grains has also allowed images to be obtained in which the skin line can be easily seen. By limiting the proportion of the tabular grains, this has not required a compromise on average contrast. In fact, the elements of the invention can be and are preferably constructed with even higher levels of average contrast than conventional soft tissue imaging elements. Finally, the presence of radiation-sensitive tabular grains allows the hydrophilic colloid layers associated with these grains to be more highly hardened than those associated with conventional non-tabular grains with little, if any reduction in covering power and a significantly increased capability for faster radiographic element processing.

DETAILED DESCRIPTION OF THE INVENTION

In the simplest contemplated form a radiographic film according to the invention for recording medical diagnostic images of soft tissue through (a) exposure by a single intensifying screen located to receive an image bearing source of X-radiation and (b) processing, including development, fixing and drying, in 90 seconds or less, exhibits the following structure:

| (I) |
|---|
| Front Layer Unit (FLU)<br>Transparent Film Support (S)<br>Back Layer Unit (BLU) |

The transparent film support S is transparent to radiation emitted by an intensifying screen for imagewise exposure of the film. Additionally the film support is transparent, at least following processing, in the visible region of the spectrum to permit simultaneous viewing of images in the front and back layer units after imagewise exposure and processing.

Although it is possible for the transparent film support to consist of a flexible transparent film, the usual construction is as follows:

| (S-I) |
| --- |
| Surface Modifying Layer Unit (SMLU)<br>Transparent Film (TF)<br>Surface Modifying Layer Unit (SMLU) |

Since the transparent film TF is typically hydrophobic, it is conventional practice to provide surface modifying layer units SMLU to promote adhesion of the hydrophilic front and back layer units. Each surface modifying layer unit typically consists of a subbing layer overcoated with a thin, hardened hydrophilic colloid layer. Any conventional dual-coated medical diagnostic film support can be employed. Medical diagnostic film supports usually exhibit these specific features: (1) the film support is constructed of polyesters to maximize dimensional integrity rather than employing cellulose acetate supports as are most commonly employed in photographic elements and (2) the film supports are blue tinted to contribute the cold (blue-black) image tone sought in the fully processed films, whereas photographic films rarely, if ever, employ blue tinted supports. Medical diagnostic film supports, including the incorporated blue dyes that contribute to cold image tones, are described in *Research Disclosure*, Vol. 184, Item 18431, August 1979, Item 18431, Section XII. Film Supports. *Research Disclosure*, Vol. 389, September 1996, Item 38957, Section XV. Supports, illustrates in paragraph (2) suitable surface modifying layer units, particularly the subbing layer components, to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly (ethylene) are specifically preferred polyester film supports.

In the simplest contemplated form of the invention the processing solution permeable front layer unit FLU consists of a single silver halide emulsion layer. To facilitate rapid access processing it is contemplated to limit coating coverages of hydrophilic colloid to less than 40 mg/dm$^2$. The coating coverage of silver halide grains is limited to less than 40 mg/dm$^2$.

Further, the FLU emulsion layer is selected so that it absorbs no more than 70 percent, preferably no more than 60 percent, of radiation employed for imagewise exposure. Limiting absorption of exposing radiation by the front layer unit is essential to permit efficient utilization of the back layer unit.

The processing solution permeable back layer unit (BLU) shares with the processing solution permeable front layer unit FLU responsibility for providing a viewable image. From 20 to 45 (preferably 25 to 40) percent and, ideally, one third of overall image density and hence corresponding percentages of the total radiation-sensitive silver halide present in the film is provided by BLU.

FLU and BLU are constructed to differ significantly in speed. While FLU is preferably constructed to exhibit the highest attainable speed compatible with acceptable image noise, as is conventional practice, BLU is intentionally constructed to exhibit a speed that is from 0.3 to 1.0 (preferably 0.4 to 0.6) log E slower than FLU. The speed of FLU is measured at a density of FLU of 1.0 above fog. Similarly, the speed of BLU is measured at a density of BLU of 1.0 above fog. To measure the density of each of FLU and BLU separately from the other, two test elements can be constructed, each satisfying invention requirements, except for one excluding radiation-sensitive silver halide from FLU and the other excluding radiation-sensitive silver halide grains from BLU. Another approach, is to imagewise expose and process a radiographic element satisfying invention requirements, followed by removal of a portion of BLU sufficient to allow the density of FLU to be measured, followed by removal a sufficient portion of FLU to allow the density of BLU to be measured.

With the wide separation of FLU and BLU speeds contemplated and the higher silver coating coverage in FLU as compared to BLU, it is apparent that average contrast, measured over the (total element) density range of 0.25 above fog to 2.0 above fog, is determined almost entirely by FLU. The film exhibits an average contrast in the range of from 2.5 to 4.0, measured over a density range above fog of from 0.25 to 2.0. The higher than conventional contrast range of from 3.5 to 4.0 is specifically preferred for mammographic imaging.

This is a higher average contrast than has been previously attained in the art while retaining an ability to see both skin line and tumor anatomical features. Retaining the ability to see the skin line is achieved by constructing BLU to exhibit a lower speed as compared to FLU. Since the radiographic image as viewed is a negative image, the areas of minimum patient density to X-radiation (e.g., an area where the X-radiation penetrates the edge of a breast) are seen as high density areas in the film. In these areas FLU is at or very near its maximum density. Therefore, for the skin line to be seen, BLU must be able to contribute a significantly higher density in areas in which the X-radiation misses the patient entirely (e.g., just beyond the skin line) than in areas at or just beneath the skin line.

Stated quantitatively, the lower speed of BLU as compared to FLU allows point gammas measured over the exposure range of from mid-scale density (a density of 2.0 above fog) to 0.6 log E higher exposures to remain above 1.0 and preferably above 1.5. These point gammas assure that sufficient density change is observed between an area at the patient's skin line and area just beyond the patient's skin line for the skin line to be visually located upon inspection of the radiographic image. A 0.6 log E range for exceeding the minimum point gammas noted above is dictated by the need to accommodate larger patients whose ability to absorb X-radiation exposures is much higher than those of smaller patients.

By constructing BLU to exhibit a lower speed than FLU, its contribution to image density increases progressively toward higher density levels. BLU can be constructed to make little or no contribution to density levels lower than average density (i.e., density levels lower than 2.0). Conversely, FLU primarily accounts for image densities below average density levels. Since cold image tones are most readily perceived at lower than average density levels as opposed at higher density levels, this allows the radiation-sensitive silver halide grains in FLU to be selected for providing cold image tones while BLU can employ radiation-sensitive thin tabular silver halide grains that are known to have the disadvantage of exhibiting warmer image tones but are otherwise highly desirable in being resistant to covering power loss with full forehardening, which translates into a faster rapid access processing capability. Thus, the radiographic elements of the invention exhibit the high average contrasts and cold image tones that are highly desired while at the same time picking up a faster access processing capability by the inclusion of thin tabular grains.

The radiation-sensitive silver halide grains in FLU exhibit an average thickness of greater than 0.3 μm. The grains can be non-tabular grains, such as those conventionally employed in single-sided mammographic films. Alternatively, the grains can be tabular grains having an average aspect ratio of less than 5 (preferably less than 3). When tabular grains are present, they are frequently present in combination with non-tabular grains. The mean ECD of the grains in FLU is preferably less than 5 μm and more preferably less than 2 μm. When greater than 50 percent of the projected area of the radiation-sensitive silver halide is accounted for by non-tabular grains, it is specifically preferred to limit grain mean ECD's to less than 1.5 μm and optimally less than 1.0 μm.

Radiation-sensitive intermediate or high average aspect ratio tabular grain emulsions are employed in BLU. That is, greater than 50 percent of the total projected area of the radiation-sensitive grains in accounted for by tabular grains having an average thickness of less than 0.3 μm and an average aspect ratio of greater than 5. Preferably the tabular grains have an average thickness of less than 0.2 μm. Generally the thinnest attainable tabular grain thicknesses are sought that produce acceptable image tone. It is preferred that the tabular grains account for at least 70 (optimally at least 90) percent of total grain projected area in BLU. Tabular grain emulsions in which tabular grains account for substantially all (>97%) of total grain projected area are known and specifically contemplated for use in the practice of this invention.

Either high bromide or high chloride emulsions or both can be present in FLU and BLU. High bromide grains in non-tabular form are generally recognized to exhibit a radiation-sensitivity advantage over non-tabular high chloride grains. High chloride grains are recognized to be capable of more rapid processing than high bromide grains. To facilitate rapid access processing it is preferred to limit iodide in the radiation-sensitive grains to less than 3 (optimally less than 1) mole percent, based on silver. Silver bromide, silver chloride, silver iodobromide, silver iodochloride, silver bromochloride, silver chlorobromide, silver iodobromochloride and silver iodochlorobromide grain compositions are all specifically contemplated.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section D. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference. Dopants for increasing imaging speed by providing shallow electron trapping sites (i.e, SET dopants) are the specific subject matter of *Research Disclosure*, Vol. 367, Nov. 1994, Item 36736.

It is specifically contemplated to reduce high intensity reciprocity failure (HIRF) by the incorporation of iridium as a dopant. To be effective for reciprocity improvement the Ir must be incorporated within the grain structure. To insure total incorporation it is preferred that Ir dopant introduction be complete by the time 99 percent of the total silver has been precipitated. For reciprocity improvement the Ir dopant can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations. The reason for this is that these dopants form deep electron traps and are capable of decreasing grain sensitivity if employed in relatively high concentrations. These non-SET Ir dopants are preferably incorporated in concentrations of at least $1\times10^{-9}$ mole per silver up to $1\times10^{-6}$ mole per silver mole. However, when the Ir dopant is in the form of a hexacoordination complex capable of additionally acting as a SET dopant, concentrations of up to about $5\times10^{-4}$ mole per silver, are contemplated. Specific illustrations of useful Ir dopants contemplated for reciprocity failure reduction are provided by B. H. Carroll, "Iridium Sensitization: A Literature Review", *Photographic Science and Engineering*, Vol. 24, No. 6 November/December 1980, pp. 265–267; Iwaosa et al U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of the emulsions can be increased by doping the grains with a hexacoordination complex containing a nitrosyl (NO) or thionitrosyl (NS) ligand. Preferred coordination complexes of this type are disclosed by McDugle et al U.S. Pat. No. 4,933,272, the disclosure of which is here incorporated by reference.

The contrast increasing dopants (hereinafter also referred to as NO or NS dopants) can be incorporated in the grain structure at any convenient location. However, if the NO or NS dopant is present at the surface of the grain, it can reduce the sensitivity of the grains. It is therefore preferred that the NO or NS dopants be located in the grain so that they are separated from the grain surface by at least 1 percent (most preferably at least 3 percent) of the total silver precipitated in forming the silver iodochloride grains. Preferred contrast enhancing concentrations of the NO or NS dopants range from $1\times10^{-11}$ to $4\times10^{-8}$ mole per silver mole, with specifically preferred concentrations being in the range from $10^{-10}$ to $10^{-8}$ mole per silver mole.

Combinations of Ir dopants and NO or NS dopants are specifically contemplated. Where the Ir dopant is not itself a SET dopant, it is specifically contemplated to employ non-SET Ir dopants in combination with SET dopants. Where a combination of SET, non-SET Ir and NO or NS dopants are employed, it is preferred to introduce the NO or NS dopant first during precipitation, followed by the SET dopant, followed by the non-SET Ir dopant.

It is, of course, recognized that image contrast is also influenced by grain dispersity. Contrast can be regulated by controlling grain COV in combination with or as an alternative to grain doping. For higher contrast levels (e.g., 3.5–4.0) it is preferred to maintain a COV of less than 20 (optimally less than 15) percent for the silver halide grains in FLU. While lower COV levels are more readily achieved using non-tabular grain emulsions, the preparation of lower COV tabular, including thin tabular, silver halide grains are well within the capability of the art. Hence, employing lower COV silver halide grains in either or both of FLU and BLU is within the capabilities of the art. It is, however, most convenient and preferred to employ tabular grain COV's of greater than 20 percent, typically 25 to 50 percent, in BLU, since this higher COV range of tabular grains in BLU is easily realized and increases the exposure range over which the minimum point gamma levels noted above can be obtained.

In a specifically preferred form the silver halide grains can be high bromide {111} tabular grains—i.e., tabular grains having {111} major faces. The following are illustrative of conventional high bromide {111} tabular grains:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Mignot et al U.S. Pat. No. 5,484,697;
Levy et al U.S. Pat. No. 5,612,177;
Antoniades et al U.S. Pat. No. 5,750,326; and
Brust et al U.S. Pat. No. 5,763,151.

Although these patents for the most part disclose thin tabular grains of intermediate and high average aspect ratios. Thicker tabular grains can be formed by adjusting the bromide ion stoichiometric excess during precipitation, as taught by Wilgus et al U.S. Pat. No. 4,434,226 and Kofron et al U.S. Pat. No. 4,439,520. The disclosures of each of these patents are here incorporated by reference.

When high chloride grains are employed in tabular form, it is preferred to employ high chloride { 100} tabular grains. The following are illustrative of conventional high bromide {111} tabular grains:

Maskasky U.S. Pat. No. 5,292,632;
House et al U.S. Pat. No. 5,320,938;
Saitou et al U.S. Pat. No. 5,652,089;
Maskasky U.S. Pat. No. 5,264,337;
Brennecke U.S. Pat. No. 5,498,518;
Brust et al U.S. Pat. No. 5,314,798;
Olm et al U.S. Pat. No. 5,457,021;
Oyamada U.S. Pat. No. 5,593,821;
Oikawa U.S. Pat. No. 5,654,133;
Saitou et al U.S. Pat. No. 5,587,281;
Yamashita U.S. Pat. No. 5,565,315;
Yamashita et al U.S. Pat. No. 5,641,620;
Yamashita et al U.S. Pat. No. 5,652,088;
Chang et al U.S. Pat. No. 5,633,041;
Chang et al U.S. Pat. No. 5,744,297;
Shirai U.S. Pat. No. 5,756,276;
Mydlarz et al U.S. Pat. No. 5,783,373;
Mydlarz et al U.S. Pat. No. 5,783,378; and
Suzuki U.S. Pat. No. 5,800,975.

The disclosures of these patents are here incorporated by reference.

Differing emulsions can be blended or coated in separate layers to fine tune emulsions for satisfying specific aim characteristics. For example, multiple coatings or blending can be conveniently undertaken to arrive at a specific speed or contrast. Both the blending of emulsions and the coating of emulsions in separate superimposed layers are well known, as illustrated by *Research Disclosure*, Item 38957, I. Emulsion grains and their preparation, E. Blends, layers and performance categories, paragraphs (1), (2), (6) and (7).

After precipitation and before chemical sensitization the emulsions can be washed by any convenient conventional technique. Conventional washing techniques are disclosed by *Research Disclosure*, Item 38957, cited above, Section III. Emulsion washing.

The emulsions can be chemically sensitized by any convenient conventional technique. Such techniques are illustrated by *Research Disclosure*, Item 38957, IV. Chemical sensitization. Sulfur and gold sensitizations are specifically contemplated.

The emulsions are spectrally sensitized to provide an absorption half-peak bandwidth that overlaps the peak emission of the intensifying screen used for their exposure. Specific illustrations of conventional spectral sensitizing dyes are provided by *Research Disclosure*, Item 18431, Section X. Spectral Sensitization, and Item 38957, Section V. Spectral sensitization and desensitization, A. Sensitizing dyes.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II. Emulsion Stabilizers, Antifoggants and Antikinking Agents.

The FLU need not be limited to a single layer. As noted above, the coating of separate silver halide grain populations in successive layers rather than blending is well known in the art. In addition, it is common practice to provide a surface overcoat (SOC) layer and, in many instances, the combination of an SOC layer and an interlayer (IL). These layers can be accommodated in the front layer unit so long as the overall coating coverage of the front layer unit of 40 $mg/dm^2$ of hydrophilic colloid is not exceeded. The contemplated sequence of layers is as follows:

| (FLU-1) |
| --- |
| Surface Overcoat (SOC)<br>Interlayer (IL)<br>Emulsion Layer (EL) |

where the emulsion layer EL is coated nearest the support.

The surface overcoat SOC is typically provided for physical protection of the emulsion layer. The surface overcoat contains a conventional hydrophilic colloid as a vehicle and can contain various addenda to modify the physical properties of the overcoats. Such addenda are illustrated by *Research Disclosure*, Item 38957, IX. Coating physical property modifying addenda, A. Coating aids, B. Plasticizers and lubricants, C. Antistats, and D. Matting agents. The interlayer IL, when present, is a thin hydrophilic colloid layer that provide a separation between the emulsion and the surface overcoat addenda. It is a quite common alternative to locate surface overcoat addenda, particularly matte particles, in the interlayer. The use of silver halide grains as matte particles to reduce gloss as taught by Childers et al U.S. Pat. No. 5,041,364 and as illustrated in the Examples below, is specifically contemplated.

The silver halide emulsion and other layers forming the processing solution permeable front layer unit contain conventional hydrophilic colloid vehicles (peptizers and binders), typically gelatin or a gelatin derivative. Conventional vehicles and related layer features are disclosed in *Research Disclosure*, Item 38957, II. Vehicles, vehicle extenders, vehicle-like addenda and vehicle related addenda. The emulsions themselves can contain peptizers of the type set out in II. above, paragraph A. Gelatin and hydrophilic colloid peptizers. Gelatin and gelatin derivatives are commonly employed as peptizers, as illustrated in the patents cited and incorporated by reference above to show tabular grain emulsions. Gelatin and gelatin derivatives are also commonly employed as binders and hence are commonly present in much higher concentrations than required to perform the peptizing function alone. The vehicle extends also to materials that are not themselves useful as peptizers. Such materials are described in II. above, C. Other vehicle components.

Cationic starch and particularly oxidized forms of cationic starch have been recently observed to be excellent peptizers for tabular grain emulsions and specifically contemplated for use in the practice of this invention. Emulsions employing cationic starch, including oxidized cationic starch, as a peptizer are illustrated by Maskasky U.S. Pat. Nos. 5,607,828, 5,620,840, 5,693,459 and 5,733,718, here incorporated by reference. Maskasky U.S. Pat. No. 5,726,008, here incorporated by reference, additionally teaches substituting cationic starch for a portion of the binder.

The elements of the invention differ from conventional radiographic elements in that only BLU is fully forehardened. To increase covering power and hence allow reduction of both the levels of silver and hydrophilic colloid required in FLU, it is contemplated to partially foreharden FLU and to supplement its hardening with a prehardener, such as glutaraldehyde, incorporated in the developer solution contained in the rapid access processor. Conventional forehardeners in II. above, B. Hardeners.

Dickerson I, here incorporated by reference, recognized that thin tabular grain emulsions exhibit covering power that is relatively invariant with increased levels of hardening. It is specifically contemplated to foreharden the thin tabular grains in BLU as taught by Dickerson I. That is, applying the swell test of Dickerson I, the thickness of BLU increases by less than 200 percent and preferably less than 100 percent. The present invention contemplates limiting hardening of the thicker silver halide grains in FLU in the same manner as non-tabular emulsion layers are conventionally employed—i.e., supplement hardening during processing is contemplated. This allows relatively high levels of covering power to be realized by the silver halide grains in FLU. For example, if the Dickerson I swell test produces a 100 percent increase in thickness of BLU, FLU preferably exhibits a swell test increase in thickness of at least 200 percent. Although the swell test is easy to apply to test coatings, in fully constructed radiographic elements it is easier to compare weight gains to compare levels of hardening. The difference in weight gain is between FLU and BLU is as large as the difference in swell. In terms of weight gain, it is preferred to adjust the levels of hardening of FLU and BLU so that percentage weight gain (i.e., water pick up) during processing of FLU is at least 50 percent greater than that of BLU.

BLU, except as specifically noted, can be identical to FLU. BLU differs in its required function from FLU in that there is no requirement that it transmit any portion of the exposing radiation that it receives. It is, in fact, necessary that BLU absorb a larger percentage of the exposing radiation it receives than FLU, otherwise an image of unacceptably degraded sharpness results. BLU exhibits an optical density to exposing radiation of at least 0.50 (corresponding to about 70 percent absorption). Preferably the optical density of BLU is at least 1.0. Since the exposing radiation received by BLU that is not absorbed by it serves no useful purpose and sharpness is increased as the percentage of exposing radiation absorbed by BLU is increased, there is no theoretical maximum optical density. There is, as a practical matter, no significant further improvement in sharpness to be realized by increasing optical density above 3.0 and, for the majority of applications, the optical density of BLU is ideally in the range of from 1.0 to 2.0.

In the wavelength ranges at which exposure of the film of the invention would ordinarily be exposed, absorption of exposing radiation is almost, if not entirely, attributable to the spectral sensitizing dye adsorbed to the surface of the latent image forming silver halide grains. Increasing the proportion of this dye in relation to silver above its optimum levels for spectral sensitization to increase optical density is precluded, since this results in desensitization of the silver halide emulsion.

What then is required in BLU to increase its optical density to the levels indicated above is a dye capable of absorbing radiation of the wavelengths employed for imagewise exposure that also exhibits little or no desensitization of the silver halide emulsion. In addition the dye must exhibit an optical density of less than 0.1 in the visible spectrum at the conclusion of film processing.

Fortunately, a variety of dyes satisfying these criteria are known in the art. When imagewise exposure occurs within the visible spectrum, such as occurs when a conventional green or red emitting intensifying screen is employed, the optical density of the dye must be reduced prior to the completion of processing. Dyes having these characteristics are disclosed in *Research Disclosure,* Item 38957, cited above, VIII. Absorbing and scattering materials, Section B. Absorbing materials, here incorporated by reference. Typically the dyes that absorb in the visible spectrum are processing solution decolorized. Usually one or more of the processing solutions alters the chromophore of the dye to eliminate optical density that is unwanted in the processed film. To eliminate or at least minimize emulsion desensitization the dyes are preferably coated as particulate dispersions, as disclosed particularly in Section B, paragraph (4).

In a preferred construction BLU can take the following form:

| (BLU-1) |
|---|
| Emulsion Layer (EL) |
| Interlayer (IL) |
| Surface Overcoat (SOC) |

The emulsion layer EL is located nearest the support. The interlayer IL preferably contains the dye used for absorption while the surface overcoat SOC is identical to the surface overcoat of FLU-1. Alternatively, the dye used for sharpness enhancement can be located in SOC and IL can be omitted.

If the dye used to increase sharpness is placed in the emulsion layer EL, it competes with the silver halide grains for exposing radiation and unacceptably lowers the imaging efficiency of the radiographic element. A specifically contemplated compromise is to the split the emulsion contained in BLU into two layers, with the optical density increasing dye being confined to the dye farthest from the support. The one location of the sharpness increasing dye that leads to unacceptable performance and is specifically excluded from the practice of the invention is placement of the dye in a layer interposed between the transparent film support and the emulsion layer of BLU nearest the support and therefore located to first receive exposing radiation. Splitting the emulsion layer allows either or both of IL and SOC to be eliminated, if desired. This allows minimal amounts of hydrophilic colloid (required for grain dispersion and avoidance of wet pressure sensitivity) to be present in BLU.

Unlike FLU, BLU in all forms requires at least two hydrophilic colloid layers. Thus, maximum hydrophilic colloid coverages in BLU equaling those in FLU are contemplated, even though BLU contains a lower percentage of total silver than FLU.

In addition to the specific features of the elements of the invention described above, it is, of course, recognized that the elements of the invention can be modified to contain any one or combination of compatible conventional features not essential to the practice of the invention. Such features can be elected from those disclosed in *Research Disclosure*, Items 18431 and 38957, cited above.

It is contemplated to image-wise expose the dual-coated radiographic film of the invention with a single intensifying screen of the type currently employed for mammographic imaging of single-sided elements. Intensifying screens having the characteristics of the back screens disclosed by Luckey et al U.S. Pat. No. 4,710,637, cited above and here incorporated by reference, are specifically contemplated. Although suitable intensifying screens have a relatively high MTF, MTF need not be nearly as high as that of the front screen required by Luckey et al, which sets a very high MTF for its front screen to compensate for an overall loss of sharpness attributable to the use of two intensifying screens. It has been discovered quite unexpectedly that a dual-coated radiographic element can produce images of satisfactory sharpness and mottle when exposed with a single intensifying screen of a type currently employed for soft tissue imaging of radiographic elements having a single emulsion layer unit. The construction of BLU makes it possible for the first time to expose a dual-coated radiographic element with a single intensifying screen while still obtaining a sharp and low mottle image.

The X-radiation employed for exposure is preferably predominantly of an energy level less than 40 keV. Although the intensifying screen can be placed to receive X-radiation that has passed through the film, the intensifying screen is preferably placed between the dual-coated film and the source of X-radiation. This placement, plus the low energy of the X-radiation allows the screen to absorb a high percentage of the X-radiation. If desired, a collimating grid can be used with the intensifying screen and dual-coated film. Illustrative collimating grids are illustrated by Freeman U.S. Pat. No. 2,133,385, Stevens U.S. Pat. No. 3,919,559, Albert U.S. Pat. No. 4,288,697, Moore et al U.S. Pat. No. 4,951,305 and Steklenski et al U.S. Pat. No. 5,259,016.

An important advantage of dual-coated radiographic elements for soft tissue imaging is that they are much better suited for rapid access processing than radiographic elements containing a single emulsion layer unit. The dual-coated films of this invention are, in fact, better suited for rapid access processing than most conventional low crossover dual-coated films, since the dual-coated films of this invention do not incorporate a crossover reduction layer interposed between the support and each emulsion layer unit. This allows the amount of hydrophilic colloid coated on each side of the support to be decreased further than is possible with a conventional dual-coated "zero crossover" film.

Rapid access processing following imagewise exposure can be undertaken in the same manner as that of conventional dual-coated medical diagnostic imaging elements. The rapid access processing of such elements is disclosed, for example, in Dickerson et al U.S. Pat. Nos. 4,803,150, 4,900,652, 4,994,355, 4,997,750, 5,108,881, 5,252,442, and 5,399,470, the disclosures of which are here incorporated by reference. A more general teaching of rapid access processing is provided by Barnes et al U.S. Pat. No. 3,545,971, the disclosure of which is here incorporated by reference. More specifically, the rapid access processing cycle and typical developer and fixer described above in connection with Kodak X-OMAT 480 RA™ is specifically contemplated for use in the practice of this invention.

EXAMPLES

The invention can be better appreciated by reference to the following specific embodiments. Coating coverages placed in parenthesis are in units of mg/dm$^2$, except as otherwise stated. Silver halide coating coverages are reported in terms of the weight of silver.

Performance comparisons of the following radiographic elements were undertaken to demonstrate the advantages of the invention. As shown, the front layer unit is positioned above the support and the back layer unit is positioned below the support.

Film A (A Conventional Single-Sided Mammographic Film)

| |
|---|
| SOC [FA] |
| Interlayer [FA] |
| Emulsion layer [FA] |
| Support |
| Density providing layer (DPLA) |
| SOC [BA] |

The following is a detailed description of the components of Film A:

| SOC [FA] | |
|---|---|
| Gelatin | (4.4) |
| Methyl methacrylate matte beads | (0.35) |
| Carboxymethyl casein | (0.73) |
| Colloidal silica (Ludox AM ™) | (1.1) |
| Polyacrylamide | (0.85) |
| Chrome alum | (0.032) |
| Resorcinol | (0.073) |
| Non-ionic silicone-polyethylene oxide block copolymer (Dow Corning Silicone ™) | (0.153) |
| Sodium p-octylphenoxydiethoxyethylsulfonate (Triton X-200 ™) | (0.26) |
| Fluoroalkyl surfactant (Lodyne S-10 ™) a mixture of $R^f(CH_2)_2SCH(CO_2H)CH_2CONH(CH_2)_3N(CH_3)_2$ and $R^f(CH_2)_2SCH(CH_2CO_2H)CONH(CH_2)_3N(CH_3)_2$ where $R^f$ is a mixture of $C_6F_{13}$, $C_8F_{17}$ and $C_{10}F_{21}$ | (0.0097) |
| Interlayer [FA] | |
| Gelatin | (4.4) |
| Emulsion Layer [FA] | |
| Cubic AgBr grains (av. ECD = 0.7 μm) sulfur and gold sensitized and spectrally sensitized to the green region of the spectrum | (51.1) |
| Gelatin | (34.9) |
| 4-Hydroxy-6-methyl-1,3,3A,7-tetraazaindene (TAI) | (1.0 g/Ag mole) |
| Maleic acid hydrazide | (0.0075) |
| Catechol disulfide | (0.42) |
| Glycerin | (0.22) |
| Potassium Bromide | (0.14) |
| Resorcinol | (2.12) |
| Acetamidophenylmercaptotetrazole (APMT) | (0.026) |

Hardener

Bis(vinylsulfonylmethyl)ether (BVSME) was distributed uniformly within the front layers at a concentration of 0.47% by weight, based on total gelatin in the front layers.

Support

The support was a 7 mil (170 μm) blue tinted polyester radiographic film support with conventional subbing layer units coated on its opposite major faces. Each subbing layer unit contained a layer of poly(acrylonitrile-co-vinylidene chloride) overcoated with a layer of gelatin (1.1).

| Density Providing Layer [DPLA] | |
|---|---|
| Gelatin | (43) |
| A mixture of the following processing solution decolorizable dyes: | |
| Bis[3-methyl-1-p-sulfophenyl)-2-pyrazollin-5-one-(4)]methineoxonol | (0.31) |
| Bis(1-butyl-3-carboxymethyl-5-barbituric acid)trimethine-oxonol | (0.11) |
| 4[4-(3-Ethyl-2(3H)-benzoxazolylidene-2-butenylidene]-3-methyl-1-p-sulfophenyl-2-pyrazolin-5-one, monosulfonate | (0.13) |
| Bis[3-methyl-1-(p-sulfophenyl)-2-pyrazolin-5-one-(4)]penta methineoxonol | (0.12) |
| SOC[BA] | |

This layer was identical to SOC[FA].

Hardener

BVSME was distributed uniformly within the back layers at a concentration of 0.47% by weight, based on total gelatin in the back layers.

Film B (A Conventional Single-Sided Mammographic Film)

Film B differed from Film A in the following respects:

(1) The radiation-sensitive silver halide grains were non-tabular silver iodobromide grains containing 1.7 mole percent iodide, based on silver, with the grains exhibiting a mean ECD of 0.6 μm. Like the radiation-sensitive grains of Film A, the grains were sulfur and gold sensitized and spectrally sensitized to the green region of the spectrum.

(2) The BVSME level was increased from 0.47 to 0.75 percent by weight, based on the weight of gelatin.

Film C (An Example Dual-Coated Film)

| |
|---|
| SOC[FC1 |
| Interlayer [FC] |
| Emulsion layer [FC] |
| Support |
| Emulsion layer [BC] |
| Density providing layer (DPLC) |
| SOC [BC] |

The following is a description of the components of Film C:

| SOC [FC] | |
|---|---|
| Gelatin | (4.4) |
| Methyl methacrylate matte beads | (0.35) |
| Carboxymethyl casein | (0.73) |
| Ludox AM ™ | (1.1) |
| Polyacrylamide | (0.85) |
| Chrome alum | (0.032) |
| Resorcinol | (0.073) |
| Dow Corning Silicone ™ | (0.153) |
| Triton X-200 ™ | (0.26) |
| Lodyne S-100 ™ | (0.0097) |
| Interlayer [FC] | |
| Gelatin | (4.4) |
| Emulsion Layer [FC] | |
| Cubic AgBr grains (av · ECD = 0.7 μm) sulfur and gold sensitized and spectrally sensitized to the green region of the spectrum | (34.9) |
| Gelatin | (24.2) |
| TAI (1.0 g/Ag mole) | |
| Maleic acid hydrazide | (0.0076) |
| Catechol disulfide | (0.2) |
| Glycerin | (0.22) |
| Potassium Bromide | (0.13) |
| Resorcinol | (2.12) |
| APMT | (0.026) |

Hardener

Bis(vinylsulfonylmethyl)ether (BVSME) was distributed uniformly within the front layers at a concentration of 2.4% by weight, based on total gelatin in the front layers.

Support

The support was a 7 mil (170 μm) blue tinted polyester radiographic film support with conventional subbing layer units coated on its opposite major faces. Each subbing layer unit contained a layer of poly(acrylonitrile-co-vinylidene chloride) overcoated with a layer of gelatin (1.1).

| Emulsion Layer [BC] | |
|---|---|
| Tabular AgBr grains ($ECD_{av}$ = 2.0 μm, $t_{av}$ = 0.10 μm) | (16.1) |

sulfur and gold sensitized and spectrally sensitized to the green region of the spectrum

| | |
|---|---|
| Gelatin | (10.8) |
| TAI (2.1 g/Ag mole) | |
| Maleic acid hydrazide | (0.0032) |
| Catechol disulfide | (0.2) |
| Glycerin | (0.11) |
| Potassium Bromide | (0.06) |
| Resorcinol | (1.0) |
| APMT | (0.013) |
| Density Providing Layer [DPLC] | |
| Gelatin | (10.8) |
| Processing solution decolorizable particles of the dye: | |
| 1-(4'-carboxyphenyl)-4-(4'-dimethylaminobenzylidene)-3-ethoxycarbonyl-2-pyrazolin-5-one | (2.2) |
| SOC[BC] | |
| Gelatin | (8.8) |
| Methyl methacrylate matte beads | (0.14) |
| Carboxymethyl casein | (1.25) |
| Ludox AM ™ | (2.19) |
| Polyacrylamide | (1.71) |
| Chrome alum | (0.066) |
| Resorcinol | (0.15) |
| Dow Corning Silicone ™ | (0.16) |
| Triton X-200 ™ | (0.26) |
| Lodyne S-100 ™ | (0.01) |

Hardener

BVSME was distributed uniformly within the back layers at a concentration of 2.4% by weight, based on total gelatin in the back layers.

Exposure and Processing

Samples of Films A, B and C were identically exposed from the front side to provide a light exposure comparable to that which would be received from mounting an intensifying screen adjacent the front screen during diagnostic medical X-ray imaging. The film was exposed through a graduated density step tablet to a MacBeth TM sensitometer for 0.5 second using a 500 watt General Electric DMX TM projector lamp calibrated to 2650° K filtered with a Corning C4010™ to simulate a green emitting X-ray stimulated intensifying screen.

The exposed film samples were identically processed using a Kodak X-OMAT TM rapid access processor set to the following processing cycle:

| | |
|---|---|
| Development | 24 seconds at 35° C. |
| Fixing | 20 seconds at 35° C. |
| Washing | 20 seconds at 35° C. |
| Drying | 20 seconds at 65° C. |

The following developer was employed:

| | |
|---|---|
| Hydroquinone | 33 g |
| Phenidone ™ | 6 g |
| $Na_2S_2O_3$ | 160 g |
| NaBr | 2.25 g |
| 5-Methylbenzotriazole | 0.125 g |
| Glutaraldehyde | 4.9 g |
| Water to 1 liter/pH 10.0 | |

The following fixer composition was employed:

| | |
|---|---|
| Sodium thiosulfate, 60% | 260.0 g |
| Sodium bisulfite | 180.0 g |
| Boric acid | 25.0 g |
| Acetic acid | 10.0 g |
| Water to 1 liter/pH 3.9–4.5 | |

Sensitometry

Films A, B and C exhibited essentially similar sensitometric properties. The sensitometric results are summarized in Table I.

TABLE I

| Film | Relative Speed | Average Contrast | Fog |
|---|---|---|---|
| A | 100 | 3.76 | 0.28 |
| B | 86 | 3.20 | 0.28 |
| C | 104 | 3.78 | 0.3 |

Speed was measured at a density of 1.0 above minimum density (fog). Speed is reported in relative log units, where a speed difference of 1 equals 0.01 log E, where E is exposure in lux-seconds.

Average Contrast was measured as the slope of a line drawn from a first characteristic curve point lying at minimum density ($D_{min}$)+0.25 density units and a second characteristic curve point lying at $D_{min}$+2.0 density units.

From Table I it would appear that Films A, B and C are all suitable for soft tissue imaging. However, the imaging superiority of Film C can be appreciated by taking a more detailed look at image discrimination measurements.

TABLE II

| Film | AC | LSC | MSγ | +0.3γ | +0.4γ | +0.6γ |
|---|---|---|---|---|---|---|
| A | 3.76 | 2.20 | 7.0 | 2.2 | 1.3 | 0.6 |
| B | 3.20 | 2.17 | 5.0 | 2.3 | 1.7 | 1.0 |
| C | 3.78 | 2.20 | 7.2 | 2.4 | 2.4 | 1.8 |

AC = Average contrast, defined above;
LSC = Lower scale contrast, measured as the slope of a line drawn from a characteristic curve point A at a density 0.85 to a point B on the characteristic curve that is at a −0.3 log E position (i.e., point B received half the exposure of point A).
MSγ = This is the point gamma measured at approximately mid-scale, which at a point MS on the characteristic curve at a density of 2.0.
+0.3γ = This is the point gamma measured at a characteristic curve point that received an exposure 0.3 log E greater than received at a density of 2.0.
+0.4γ = This is the point gamma measured at a characteristic curve point that received an exposure 0.4 log E greater than received at a density of 2.0.
+0.6γ = This is the point gamma measured at a characteristic curve point that received an exposure 0.6 log E greater than received at a density of 2.0.

The present invention demonstrates a significant advantage in that the point gammas extending over an exposure range from mid-scale to +0.6 log E are all greater than 1.5.

Thus sufficient image discrimination was present over this exposure range that a viewer of a medical diagnostic radiographic image using Film C can judge the location of an anatomical feature of interest in relation to the skin line. With Film A this capability is not present over the +0.6 log E exposure range of interest, and with Film B this capability is clearly inferior.

The invention has been described in detail with particular reference to certain preferred embodiments thereof, but it will be understood that variations and modifications can be effected within the spirit and scope of the invention.

What is claimed is:

1. A radiographic film for recording medical diagnostic images of soft tissue through (a) exposure by a single intensifying screen located to receive an image bearing source of X-radiation and (b) processing, including development, fixing and drying, in 90 seconds or less comprised of a film support transparent to radiation emitted by the intensifying screen and having opposed front and back major faces and an image-forming portion for providing, when imagewise exposed by the intensifying screen and processed, an average contrast in the range of from 2.5 to 4.0, measured over a density above fog of from 0.25 to 2.0, wherein the image-forming portion is comprised of a processing solution permeable front layer unit coated on the front major face of the support capable of absorbing up to 70 percent of the exposing radiation and containing (a) hydrophilic colloid, the hydrophilic colloid being limited to less than 40 mg/dm$^2$, and (b) radiation-sensitive silver halide grains having an average thickness of greater than 0.3 $\mu$m and an average aspect ratio of less than 5, the coating coverage of the silver halide grains being limited to less than 40 mg/dm$^2$, based on the weight of silver, and a processing solution permeable back layer unit coated on the back major face of the support containing (a) hydrophilic colloid, the hydrophilic colloid being limited to less than 40 mg/dm$^2$, (b) silver in the form of radiation-sensitive silver halide grains accounting for from 20 to 45 percent of the total radiation-sensitive silver halide present in the film, tabular grains having a thickness of less than 0.3 $\mu$m and an average aspect ratio of greater than 5 accounting for at least 70 percent of the total projected area of the radiation-sensitive silver halide grains in the back layer unit, and (c) a dye capable of providing an optical density of at least 0.40 in the wavelength region of the exposing radiation intended to be recorded and an optical density of less than 0.1 in the visible spectrum at the conclusion of film processing, the dye being excluded from a first layer of the back layer unit containing at least 20 percent of the radiation-sensitive grains within the back layer unit and being present in at least one remaining layer coated farther from the support than the first layer, the hydrophilic colloid of the front layer unit being hardened to a lesser extent than the hydrophilic colloid of the back layer unit and the back layer unit having a speed ranging from 0.3 log E to 1.0 log E slower than the front layer unit, where the speed of the front layer unit is measured at a density of the front layer unit of 1.0 above fog and the speed of the back layer unit is measured at a density of the back layer unit of 1.0 above fog.

2. A radiographic film for recording medical diagnostic images of soft tissue according to claim 1 wherein the dye in the back layer unit is located to receive the exposing radiation after the radiation-sensitive silver halide grains.

3. A radiographic film for recording medical diagnostic images of soft tissue according to claim 1 wherein each of the back layer unit contains less than 30 mg/dm$^2$ of hydrophilic colloid.

4. A radiographic film for recording medical diagnostic images of soft tissue according to claim 1 wherein the back layer unit contains from 25 to 40 percent of total silver present in the film.

5. A radiographic film for recording medical diagnostic images of soft tissue according to claim 1 wherein the back layer unit exhibits an optical density of up to 3.00 in the wavelength region of the exposing radiation.

6. A radiographic film for recording medical diagnostic images of soft tissue according to claim 5 wherein the back layer unit exhibits an optical density of at least 1.00 in the wavelength region of the exposing radiation.

7. A radiographic film for recording medical diagnostic images of soft tissue according to claim 1 wherein the dye exhibits a half peak absorption bandwidth over the spectral region of peak emission by the intensifying screen.

8. A radiographic film for recording medical diagnostic images of soft tissue according to claim 1 wherein the radiation-sensitive silver halide grains contain greater than 50 mole percent bromide and less than 4 mole percent iodide, based on total silver.

9. A radiographic film for recording medical diagnostic images of soft tissue according to claim 8 wherein the radiation-sensitive silver halide grains are silver iodobromide grains and contain less than 1 mole percent iodide, based on total silver.

10. A radiographic film for recording medical diagnostic images of soft tissue according to claim 1 wherein the radiation-sensitive grains in the front layer unit are non-tabular grains.

11. A radiographic film for recording medical diagnostic images of soft tissue according to claim 1 wherein the tabular grains have an average thickness in the range of from 0.2 to 0.07 $\mu$m.

12. A radiographic film for recording medical diagnostic images of soft tissue according to claim 1 wherein the tabular grains account for greater than 70 percent of total projected area of the radiation-sensitive silver halide grains in the back layer unit.

13. A radiographic film for recording medical diagnostic images of soft tissue according to claim 1 wherein the back layer unit has a speed ranging from 0.4 log E to 0.6 log E slower than the front layer unit.

14. A radiographic film for recording medical diagnostic images of soft tissue according to claim 1 wherein point gammas at densities ranging from 2.0 above fog ranging to 0.6 log E greater exposure levels are greater than 1.0.

15. A radiographic film for recording medical diagnostic images of soft tissue according to claim 1 wherein point gammas at densities ranging from 2.0 above fog ranging to 0.6 log E greater exposure levels are greater than 1.5.

* * * * *